US009578405B2

(12) United States Patent
Sun et al.

(10) Patent No.: US 9,578,405 B2
(45) Date of Patent: Feb. 21, 2017

(54) ELECTRONIC SPEECH AID DEVICE

(71) Applicant: Wen-Tsung Sun, Taoyuan (TW)

(72) Inventors: Wen-Tsung Sun, Taoyuan (TW); Ho-Ching Sun, Taoyuan (TW); Ho-I Sun, Taoyuan (TW)

(73) Assignee: Wen-Tsung Sun, Taoyuan (TW)

( * ) Notice: Subject to any disclaimer, the term of this patent is extended or adjusted under 35 U.S.C. 154(b) by 0 days.

(21) Appl. No.: 14/808,302

(22) Filed: Jul. 24, 2015

(65) Prior Publication Data

US 2016/0037247 A1 Feb. 4, 2016

(30) Foreign Application Priority Data

Jul. 30, 2014 (TW) ..... 103213505 U

(51) Int. Cl.

| | |
|---|---|
| ***H04R 1/08*** | (2006.01) |
| ***H04R 1/10*** | (2006.01) |
| ***G10L 13/033*** | (2013.01) |
| *G10L 21/0208* | (2013.01) |

(52) U.S. Cl.

CPC ..... *H04R 1/08* (2013.01); *G10L 13/033* (2013.01); *H04R 1/1016* (2013.01); *H04R 1/1083* (2013.01); *G10L 21/0208* (2013.01)

(58) Field of Classification Search

None

See application file for complete search history.

(56) References Cited

U.S. PATENT DOCUMENTS 5,295,193 A * 3/1994 Ono ..... H04R 1/1016 381/151
5,692,059 A 11/1997 Kruger
5,757,934 A 5/1998 Yokoi
7,680,656 B2 * 3/2010 Zhang ..... G10L 21/0208 704/231
2006/0079291 A1 * 4/2006 Granovetter ..... G06F 17/289 455/563
2014/0081631 A1 3/2014 Zhu et al.
2014/0270230 A1 * 9/2014 Oishi ..... H04R 1/1016 381/74
2014/0363003 A1 * 12/2014 Kupershmidt ..... H04R 29/00 381/58
2015/0179189 A1 * 6/2015 Dadu ..... G10L 15/20 704/275

OTHER PUBLICATIONS

European Search Report issued by the European Patent Office on Jan. 4, 2016 in European Patent Application No. 15178172.1, 8 pages.

* cited by examiner

*Primary Examiner* — Paul Huber

(74) *Attorney, Agent, or Firm* — Faegre Baker Daniels LLP

(57) ABSTRACT

An electronic speech aid device to be worn by a wearer, includes an ear plug, a micro-microphone, a processing module and a micro-speaker. The ear plug is to be inserted into an acoustic meatus of the wearer. The micro-microphone is disposed on the ear plug for receiving a larynx sound, which results from attempt by the wearer to speak, from a larynx of the wearer through the acoustic meatus and for converting the larynx sound into a larynx-sound signal. The processing module is electrically connected to the micro-microphone for receiving and processing the larynx-sound signal to output a voice signal. The micro-speaker is electrically coupled to the processing module for receiving and outputting the voice signal.

8 Claims, 4 Drawing Sheets

ELECTRONIC SPEECH AID DEVICE

CROSS-REFERENCE TO RELATED APPLICATION

This application claims priority to Taiwanese Application No. 103213505, filed Jul. 30, 2014, the entire disclosure of which is hereby expressly incorporated herein by reference.

FIELD

The disclosure relates to an electronic speech aid device, and more particularly to an electronic speech aid device for collecting a larynx sound from an acoustic meatus of a wearer.

BACKGROUND

Conventional artificial throat is a silicon tracheoesophageal voice prosthesis disposed in a tracheoesophageal puncture of a user to provide a speech aid function. However, self-replacement and maintenance of the conventional artificial throat is troublesome to the user.

Another conventional electro-larynx is a hand-held device for abutting against the neck adjacent to the vocal cords of the user for producing speech. However, it is inconvenient for the user to hold the electro-larynx during use and the electro-larynx also adversely affects the user's appearance.

SUMMARY

Therefore, an object of the disclosure is to provide an electronic speech aid device that can alleviate at least one of the drawbacks of the conventional speech aid device.

According to one aspect of the present disclosure, an electronic speech aid device to be worn by a wearer includes an ear plug, a micro-microphone, a processing module and a micro-speaker. The ear plug is to be inserted into an acoustic meatus of the wearer. The micro-microphone is disposed on the ear plug for receiving a larynx sound, which results from attempt by the wearer to speak, from a larynx of the wearer through the acoustic meatus and for converting the larynx sound into a larynx-sound signal. The processing module is electrically connected to the micro-microphone for receiving the larynx-sound signal therefrom and for processing the larynx-sound signal to output a voice signal. The micro-speaker is electrically coupled to the processing module for receiving the voice signal and for outputting the voice signal.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
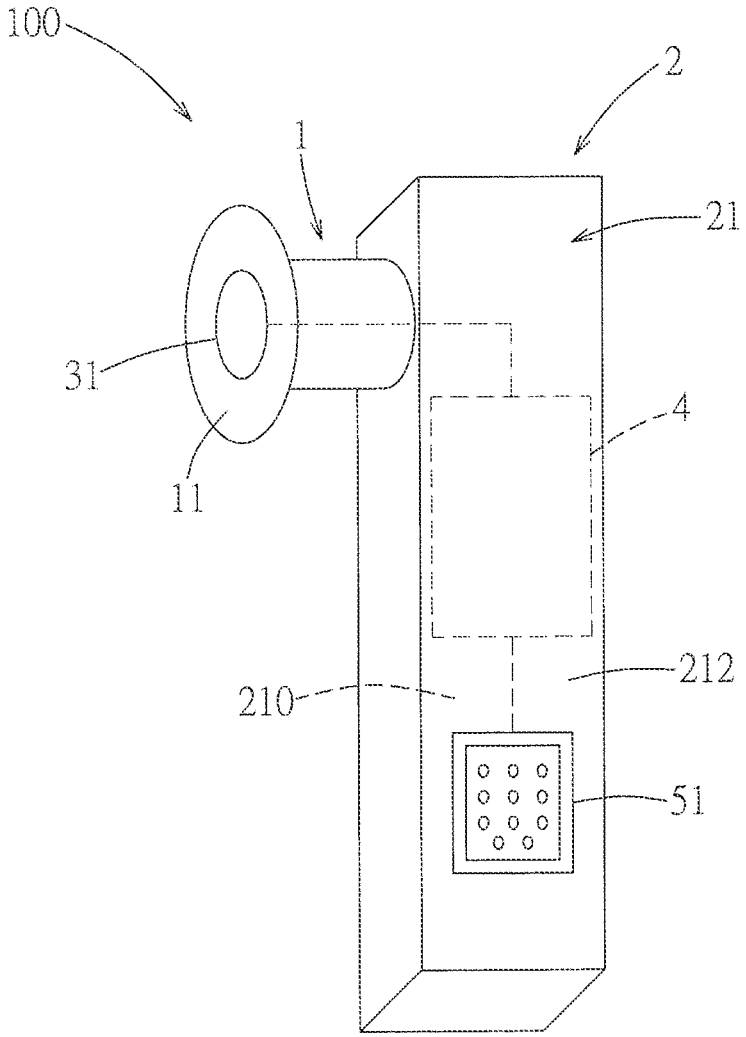
FIG. 1 is a schematic perspective view of a first embodiment of the electronic speech aid device according to the present disclosure.
Figure 2:
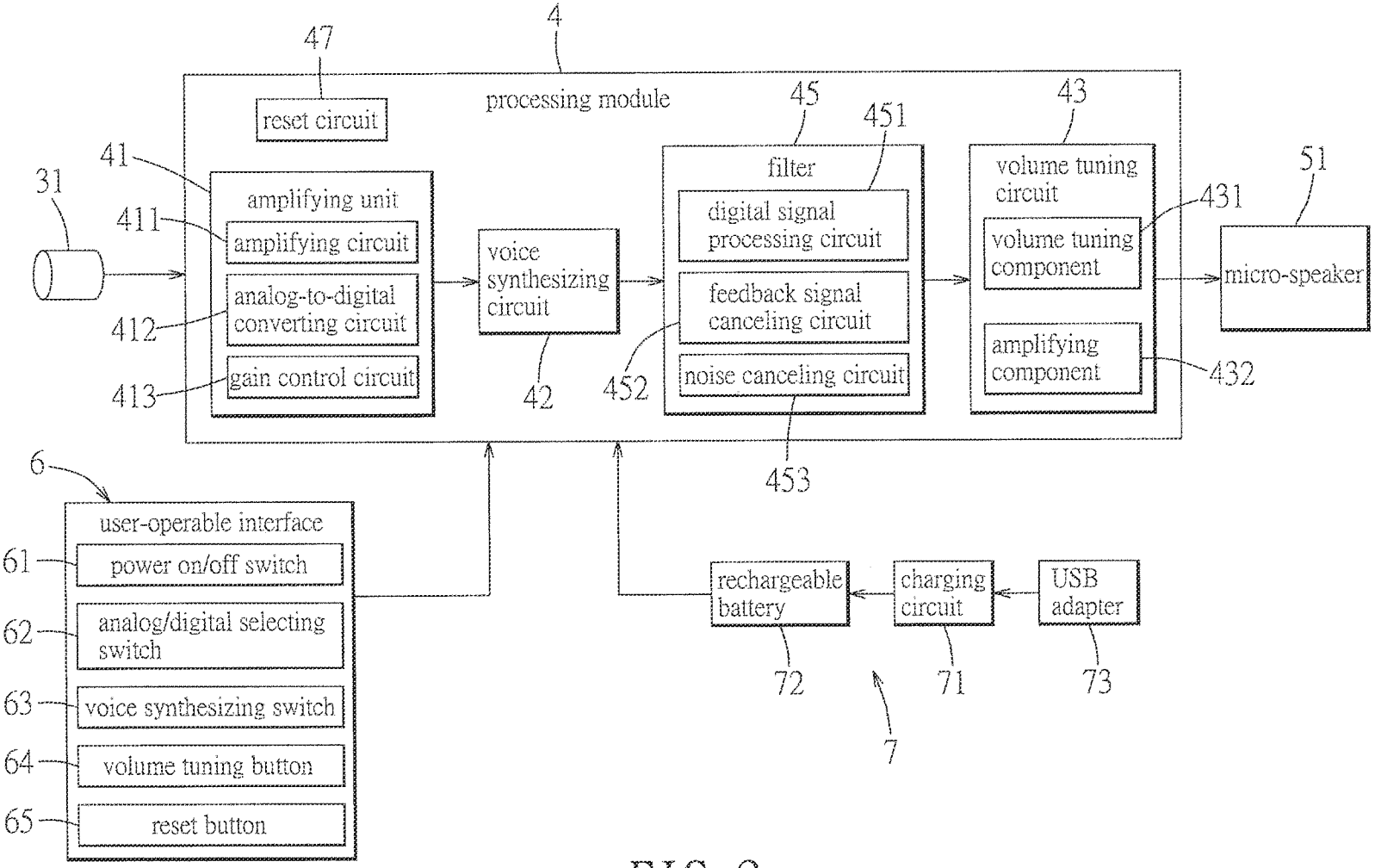
FIG. 2 is a block diagram of the first embodiment illustrating components of the electronic speech aid device.

Referring to FIGS. 1 and 2, the electronic speech aid device 100 according to the first embodiment of this disclosure is adapted to be worn by a wearer, and includes an ear plug 1, a housing 2, a micro-microphone 31, a processing module 4, a micro-speaker 51, a user-operable interface 6 (not shown in FIG. 1) and a charging unit 7.

The ear plug 1 is to be inserted into an acoustic meatus of the wearer. The housing 2 includes a surrounding wall 21 having an outer surface 212 that is connected to the ear plug 1, and defines an accommodating space 210 that receives the processing module 4 therein.

The user-operable interface 6 is provided for user to control operation of the processing module 4 and includes a power on/off switch 61, an analog/digital selecting switch 62, a voice synthesizing switch 63, a volume tuning button 64 and a reset button 65. The details of the user-operable interface 6 will be described later together with the processing module 4.

The charging unit 7 includes a charging circuit 71, a rechargeable battery 72 and an USB adapter 73. The rechargeable battery 72 is electrically connected to and provides electricity to the processing module 4. The USB adapter 73 is electrically connectable to a power source such as a power socket (not shown) and is electrically connected to the charging circuit 71. The charging circuit 71 enables transfer of electric power received from the power socket via the USB adapter 73 to the rechargeable battery 72 while the USB adapter 73 is connected to the power socket, for example, when the residual power of the rechargeable battery 72 falls below a predetermined threshold.

The micro-microphone 31 is disposed on an ear canal-facing surface 11 of the ear plug 1 for receiving a larynx sound, which results from attempt by the wearer to speak, from a larynx of the wearer through the acoustic meatus and for converting the larynx sound into a larynx-sound signal.

The processing module 4 includes an amplifying unit 41, a voice synthesizing circuit 42, a volume tuning circuit 43, a filter 45 and a reset circuit 47.

The amplifying unit 41 is electrically connected to the micro-microphone 31 for receiving the larynx-sound signal therefrom and includes an amplifying circuit 411, an analog-to-digital converting circuit 412 and a gain control circuit 413.

The analog/digital selecting switch 62 is operated to switch between an analog output enabling mode, where the gain control circuit 413 receives and processes the larynx-sound signal and outputs a signal associated with the larynx-sound signal in analog form, and a digital output enabling mode, where the analog-to-digital converting circuit 412 receives and processes the larynx-sound signal and outputs a signal associated with the larynx-sound signal in digital form.

In this embodiment, when the analog/digital selecting switch 62 is in the digital output enabling mode, the larynx-sound signal is amplified by the amplifying circuit 411 prior to being received and processed by the analog-to-digital converting circuit 412. The gain control circuit 413 is for adjusting input-to-output gain thereof inversely to intensity of the larynx-sound signal in order to produce the signal associated with the larynx-sound signal in analog form.

The voice synthesizing circuit 42 is for converting aspirated sound component in the signal associated with the larynx-sound signal received from the amplifying unit 41 into natural voice component as controlled by the voice synthesizing switch 63.

The filter 45 includes a digital signal processing circuit 451, a feedback signal canceling circuit 452 and a noise canceling circuit 453. The digital signal processing circuit 451 is provided for filtering the signal associated with the larynx-sound signal in the digital format when the analog/digital selecting switch 62 is in the digital output enabling mode and the filter 45 receives the signal associated with the larynx-sound signal in digital form.

The feedback signal canceling circuit 452 and the noise canceling circuit 453 are for respectively eliminating a feedback signal and a noise in the signal associated with the larynx-sound signal received from the voice synthesizing circuit 42 in the analog format when the analog/digital selecting switch 62 is in the analog output enabling mode. The noise canceling circuit 452 is capable of eliminating noise such as environmental noise and the feedback signal canceling circuit 451 eliminates the feedback signal by acoustic coupling in this embodiment.

The volume tuning circuit 43 includes a volume tuning component 431 configured as a variable resistor that is controlled by the volume tuning button 64 and an amplifying component 432 cooperating with the variable resistor to effect volume adjustment of a filtered signal associated with the larynx-sound signal received from the filter 45 and to output a voice signal.

The micro-speaker 51 is disposed on the outer surface 212 of the surrounding wall 21, is distal from the ear plug 1 and is electrically coupled to the volume tuning circuit 43 of the processing module 4 for receiving the voice signal and for outputting the voice signal.

It should be noted that the micro-speaker 51 may be disposed somewhere other than on the outer surface 212 of the surrounding wall 21 in other embodiments of the present disclosure and the configuration of the micro-speaker 51 is not limited to what is shown in FIG. 1.

The reset circuit 47 is for resetting the speech aid device 100 to factory default settings when the reset button 65 of the user-operable interface 6 is pressed.

Figure 3:
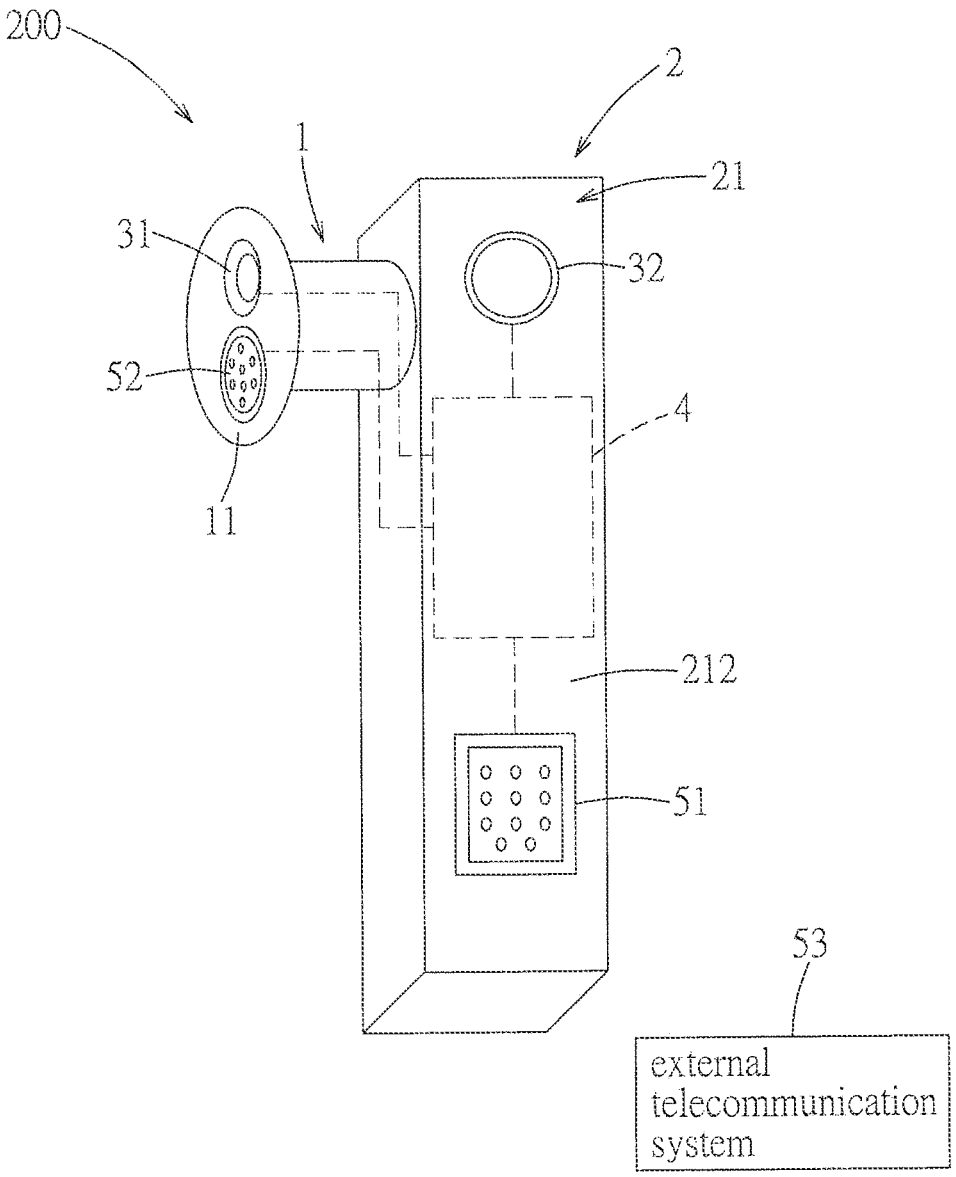
FIG. 3 is a schematic perspective view of a second embodiment of the electronic speech aid device according to the present disclosure.
Figure 4:
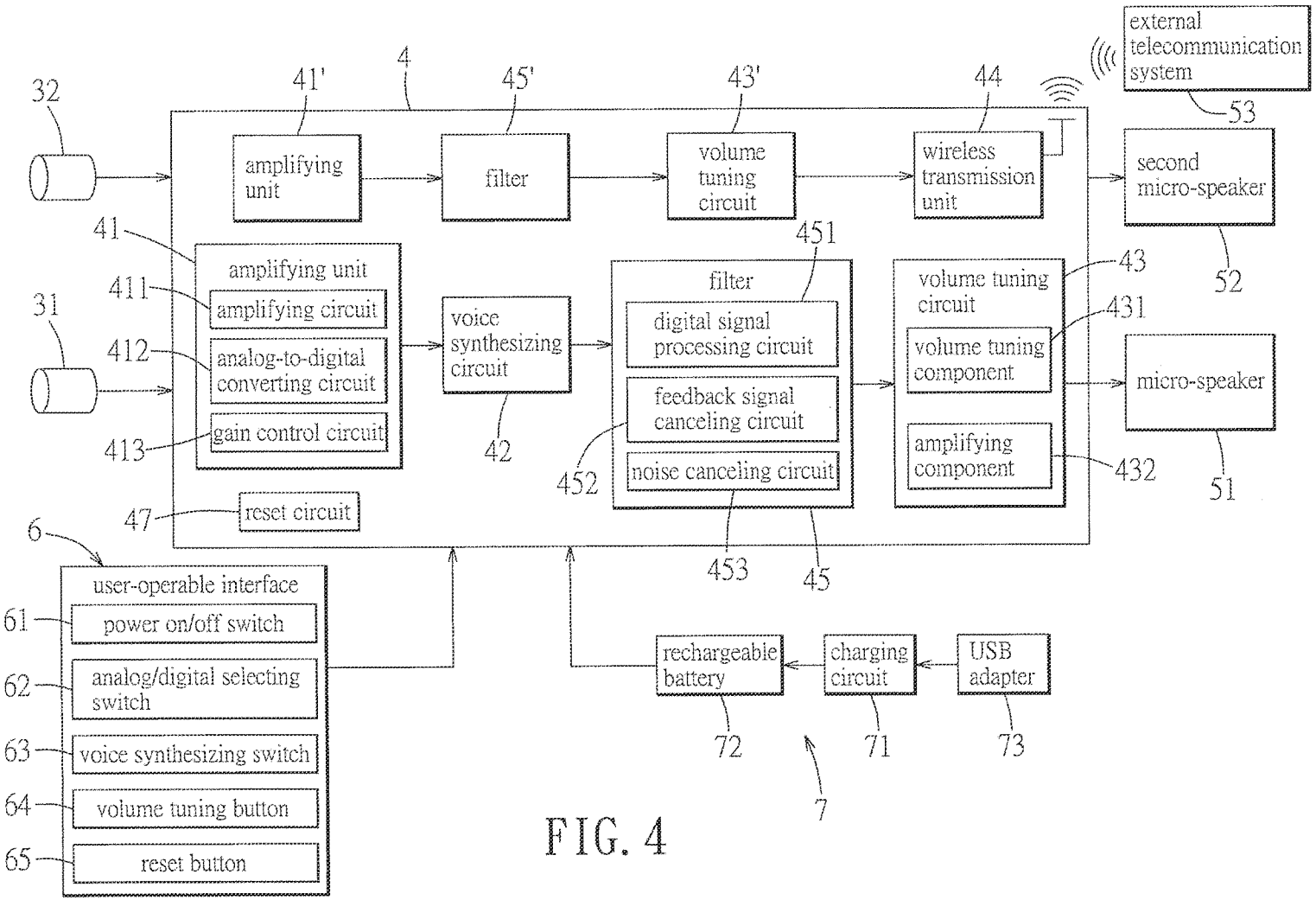
FIG. 4 is a block diagram of the second embodiment illustrating components of the electronic speech aid device.

Referring to FIGS. 3 and 4, a second embodiment of the speech aid device 200 according to this disclosure is shown. The second embodiment is similar to the first embodiment and the difference therebetween resides in the following. In the second embodiment, the speech aid device 200 further includes a second micro-microphone 32 and a second micro-speaker 52, and the processing module 4 further includes an amplifying unit 41', a volume tuning circuit 43' and a filter 45'.

The second micro-microphone 32 is disposed on the outer surface 212 of the surrounding wall 21, is distal from the ear plug 1 and the micro-speaker 51 and is electrically connected to the processing module 4. The second micro-microphone 32 is configured for capturing external sound and is for converting the external sound into an external audio signal.

The processing module 4 is further configured for processing the external audio signal to output a processed audio signal in a manner similar to that for processing the larynx-sound signal using the amplifying unit 41', the volume tuning circuit 43' and the filter 45'.

The second micro-speaker 52 is disposed on the ear plug 1, is electrically connected to the processing module 4 for receiving the processed audio signal from the processing module 4 and is for outputting the processed audio signal. By this way, the speech aid device 200 may also serve as a hearing-aid device.

It should be noted that, in this embodiment, the processing module 4 further includes a wireless transmission unit 44 so that the speech aid device 200 is capable of cooperating with an external telecommunication system 53. Specifically, the wireless transmission unit 44 is for wirelessly outputting the voice signal to the external telecommunication system 53 and for wirelessly receiving a telecommunication audio signal from the external telecommunication system 53 for playback via the second micro-speaker 52. Essentially, the speech aid device 200 may serve as a "hands-free headset".

To sum up, by virtue of the micro-microphone 31 that is mounted on the ear plug 1 for receiving the larynx sound from the larynx of the wearer through the acoustic meatus and the micro-speaker 51 that outputs the voice signal synthesized from and associated with the larynx sound, it is relatively convenient for the wearer to use the speech aid device 100, 200 and the appearance of the wearer does not differ significantly from people capable of normal speech to thereby provide a relatively good quality of life to the wearer.

While the disclosure has been described in connection with what are considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. An electronic speech aid device adapted to be worn by a wearer, comprising:

an ear plug adapted to be inserted into an acoustic meatus of the wearer;

a first micro-microphone disposed on said ear plug for receiving a larynx sound, which results from attempt by the wearer to speak, from a larynx of the wearer through the acoustic meatus and for converting the larynx sound into a larynx-sound signal;

a processing module electrically connected to said first micro-microphone for receiving the larynx-sound signal therefrom and for processing the larynx-sound signal to output a voice signal, wherein said processing module includes a filter for eliminating at least one of a feedback signal and a noise in a signal associated with the larynx-sound signal, said filter including a digital signal processing circuit and a feedback signal canceling circuit;

a user-operable interface including an analog/digital selecting switch operable to switch between an analog output enabling mode and a digital output enabling mode;

a first micro-speaker electrically coupled to said processing module for receiving the voice signal and for outputting the voice signal; and wherein said digital signal processing circuit filters the signal associated with the larynx-sound signal in a digital format when said analog/digital selecting switch is in the digital output enabling mode, and said feedback signal canceling circuit eliminates the feedback signal in the signal associated with the larynx-sound signal in an analog format when said analog/digital selecting switch is in the analog output enabling mode.

2. The electronic speech aid device as claimed in claim 1, wherein said processing module includes a gain control circuit for adjusting input-to-output gain of the larynx-sound signal inversely to intensity of the larynx-sound signal so as to generate a signal associated with the larynx-sound signal.

3. The electronic speech aid device as claimed in claim 1, wherein said processing module includes a voice synthesizing circuit for converting aspirated sound component in a signal associated with the larynx-sound signal into natural voice component.

4. The electronic speech aid device as claimed in claim 1, further comprising a housing that includes a surrounding wall, wherein said surrounding wall has an outer surface that is connected to said ear plug, and defines an accommodating space that receives said processing module therein.

5. The electronic speech aid device as claimed in claim 1, wherein said first micro-speaker is disposed on said outer surface of said surrounding wall and is distal from said ear plug.

6. The electronic speech aid device as claimed in claim 1, wherein said processing module includes a wireless transmission unit for wirelessly outputting the voice signal to an external telecommunication system and for wirelessly receiving telecommunication audio signal from the external telecommunication system.

7. The electronic speech aid device as claimed in claim 1, further comprising a second micro-speaker disposed on said ear plug and electrically connected to said processing module, wherein said processing module is further for processing an external audio signal to output a processed audio signal, and said second micro-speaker is electrically coupled to said processing module for receiving the processed audio signal and for outputting the processed audio signal.

8. The electronic speech aid device as claimed in claim 7, further comprising a second micro-microphone that is electrically connected to said processing module, and that is configured for capturing external sound and for converting the external sound into the processed audio signal.

* * * * *